US008485832B2

(12) United States Patent
Mashiyama et al.

(10) Patent No.: US 8,485,832 B2
(45) Date of Patent: Jul. 16, 2013

(54) ELECTRICAL CONNECTOR

(75) Inventors: Jinichi Mashiyama, Tokyo (JP); Toshihiko Hirai, Tokyo (JP); Yoshinori Iwashita, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 13/469,787

(22) Filed: May 11, 2012

(65) Prior Publication Data

US 2012/0289096 A1 Nov. 15, 2012

(30) Foreign Application Priority Data

May 13, 2011 (JP) ..... 2011-107743

(51) Int. Cl.
*H01R 12/00* (2006.01)

(52) U.S. Cl.
USPC ..... 439/74

(58) Field of Classification Search
USPC ..... 439/74, 660
See application file for complete search history.

(56) References Cited

U.S. PATENT DOCUMENTS

| | | | | |
|---|---|---|---|---|
| 7,901,218 | B2 * | 3/2011 | Sato et al. | 439/74 |
| 8,235,733 | B2 * | 8/2012 | Yamashiro et al. | 439/83 |
| 8,408,931 | B2 * | 4/2013 | Sato et al. | 439/357 |
| 2009/0176386 | A1 * | 7/2009 | Wu | 439/74 |
| 2010/0068900 | A1 * | 3/2010 | Wu et al. | 439/74 |
| 2010/0221928 | A1 * | 9/2010 | Sato et al. | 439/74 |
| 2010/0291776 | A1 * | 11/2010 | Huang et al. | 439/74 |
| 2013/0012039 | A1 * | 1/2013 | Nose et al. | 439/74 |

FOREIGN PATENT DOCUMENTS

| | | | |
|---|---|---|---|
| JP | 2009-517802 | A | 4/2009 |
| JP | 2009-266629 | A | 11/2009 |
| JP | 2010-198996 | A | 9/2010 |

* cited by examiner

*Primary Examiner* — Phuong Dinh
(74) *Attorney, Agent, or Firm* — Procopio, Cory, Hargreaves & Savitch LLP

(57) ABSTRACT

Upon plug and receptacle connectors of an electrical connector being fitted with each other, positioning recesses of a block of the plug connector engage positioning protrusions of a housing of the receptacle connector to achieve positioning of the two connectors in their width directions. Inclined portions of receptacle contacts of the receptacle connector are commensurate with inclined portions of inserting holes of the housing so that a backup function of the housing for the receptacle contacts is adjusted to obtain a stable connection between the plug and receptacle connectors. First chamfered portions of the receptacle contacts engage recesses of the plug contacts to generate tactile clicks and to achieve the positioning and contacting between the plug and receptacle contacts. The plug contacts are embraced between contact portions and elastic portions of the receptacle contacts to obtain a stable connection between the both contacts.

4 Claims, 9 Drawing Sheets

ELECTRICAL CONNECTOR

BACKGROUND OF THE INVENTION

This invention relates to an electrical connector for use in electric and electronic appliances and particularly in communication systems such as mobile phone terminals, audio units and the like, and more particularly an electrical connector having a construction maintaining a required strength and a stable fitting between plug and receptacle connectors constituting the electrical connector, thereby achieving a connection stability, and at the same time accomplishing a reduced overall height and a miniaturization (mounted space-saving construction on substrates) of the electrical connector.

In general, an electrical connector for connecting two substrates includes a plug connector and a receptacle connector. The plug connector is mounted on one substrate, and the receptacle connector is mounted on the other substrate so that the plug and receptacle connectors are caused to be fitted with each other to connect the two substrates each other. Usually, such a plug connector includes at least plug contacts and a block for holding these plug contacts, and a receptacle connector includes at least receptacle contacts and a housing for holding these receptacle contacts. These plug and receptacle connectors often include fixtures, if necessary.

RELATED ART

The applicant had proposed following patent applications in the past.

Patent Document 1: Japanese Patent Application Opened No. 2009-266629

Patent Document 2: Japanese Patent Application Opened No. 2009-517802

Patent Document 3: Japanese Patent Application Opened No. 2010-198996

Recently, the trend in electric and electronic appliances, particularly communication appliances has been toward increasingly smaller geometries. With such a trend, the miniaturization of connectors has also progressed. Under these circumstances, there is a requirement for a stable connection between two connectors owing to their sufficient strength and stable fitting, and there are further requirements with respect to the miniaturization (mounted space-saving construction on substrates) and the reduced overall height of the electrical connector. In order to realize the miniaturization and reduced overall height of the electrical connector, walls of the connector must be as thin as possible. In such a case, however, it is unavoidable that the strength of the connector should be lowered.

The above mentioned applicant's proposal, Japanese Patent Application Opened No. 2009-266629 (Patent Document 1) has attempted to overcome these problems. In this proposal, however, each of plug contacts is in contact with each of receptacle contacts at only one point so that it may be difficult to obtain a stable connection between the plug and receptacle connectors. To overcome this problem, the receptacle contacts are each provided with a curved elastic portion. However, such curved elastic portions impede the miniaturization in width directions. For the purpose of obtaining a sufficient strength, walls on both sides extending in the longitudinal directions are made thicker, but such thick walls also impede the miniaturization of the connector.

In another applicant's proposal, Japanese Patent application Opened No. 2009-517802 (Patent Document 2), the same holds true regarding a point contact between plug and receptacle contacts, curved elastic portions of the receptacle contacts, and longitudinal thick walls on both sides, resulting in impediments to the above requirements.

In a further applicant's proposal, Japanese Patent application Opened No. 2010-198996 (Patent Document 3), a plug connector and a receptacle connector are each provided at their both the longitudinal ends with fixtures. The respective fixtures are caused to be engaged with each other to bring the plug and receptacle connectors into electrically continuity with each other. Therefore, this construction may impede a miniaturization of the connector in longitudinal directions. Since contact portions of receptacle contacts stand upright, central portions of the receptacle connector must be thick, in order to obtain sufficient displacements of contact portions of the receptacle contacts. Accordingly, the thick central portion of the receptacle connector provides an impediment to a miniaturization of the connector in width directions.

SUMMARY OF THE INVENTION

The invention has been completed in view of these problems with the prior art, and the invention has an object to provide an electrical connector having a sufficient strength and performing stable fitting between plug and receptacle connectors to achieve a complete stability of connection, while fully complying with the imposed requirements with respect to the miniaturization (mounted space-saving construction on substrates) and the reduced overall height of the electrical connector.

The above object can be accomplished by the electrical connector of the present invention.

As can be seen from the above description, the electrical connector according to the invention can bring about the following significant functions and effects.

With the electrical connector according to the invention, a stable connection between the plug and receptacle connectors can be achieved by its sufficient strength and stable fitting, and at the same time its miniaturization (mounted space-saving construction on substrates) and a reduced overall height are also accomplished. In other words, in spite of the miniaturized and reduced overall height electrical connector, a sufficient strength and a stable fitting can be assured to achieve the complete stability of the connection.

The invention will be more fully understood by referring to the following detailed specification and claims taken in connection with the appended drawings.

DESCRIPTION OF THE PREFERRED EMBODIMENTS

Figure 1A:
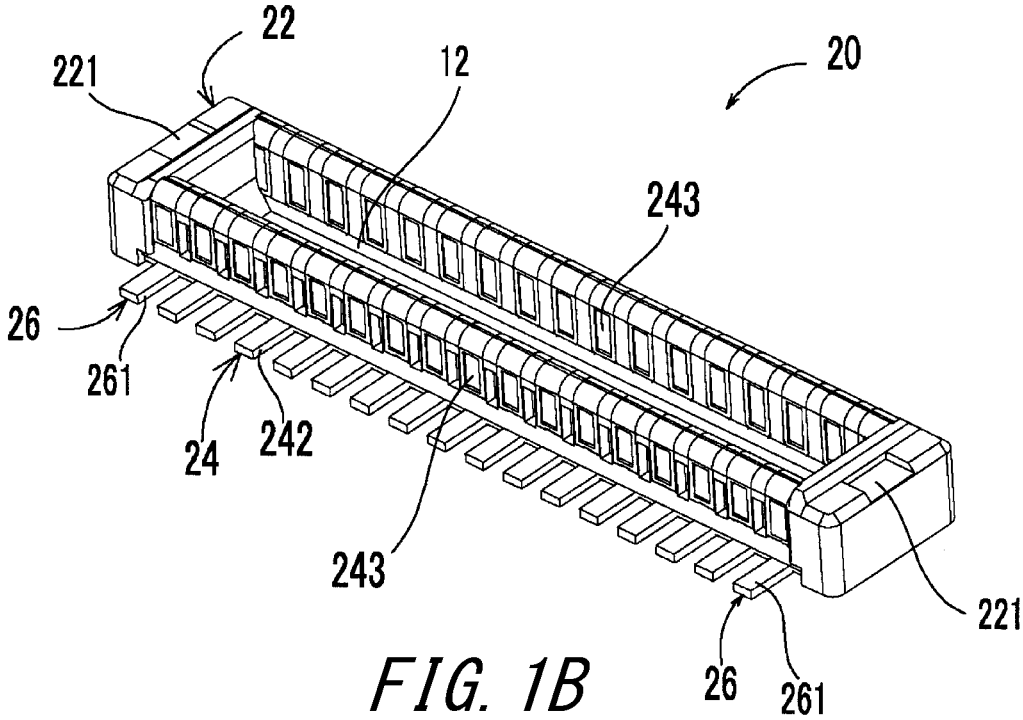
FIG. 1A is a perspective view of a plug connector of an electrical connector according to the invention viewed from its fitting side.
Figure 1B:
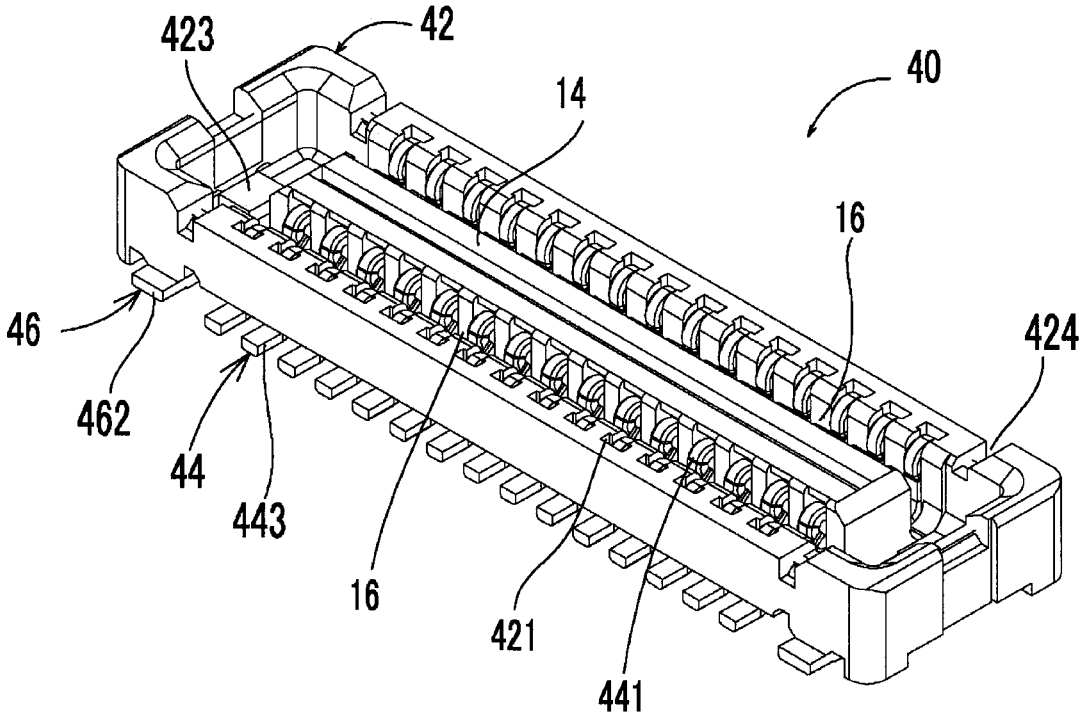
FIG. 1B is a perspective view of a receptacle connector of the electrical connector according to the invention viewed from its fitting side.

Preparatory to a description of an electrical connector 10 according to the invention, substrates for mounting thereon a plug connector and a receptacle connector constituting the electrical connector 10, respectively, will be briefly explained. Such substrates include stiff or hard ones and compliant or flexible ones. By way of example, hard substrates used in the electrical connector according to the invention are described herein. Such hard substrates have lands to be connected to connection portions of plug contacts or receptacle contacts, and circuit patterns for connecting the lands to main circuits.

The electrical connector 10 according to the invention will then be explained referring to the drawings. First, plug contacts 24 as components of the plug connector 20 will be described. The plug contacts 24 are made of a metal and formed by means of the press-working of the known technique. Preferred metals from which to form the plug contacts 24 include beryllium copper, phosphor bronze and the like which comply with the requirements as to springiness, electric conductivity, and the like.

Figure 4A:
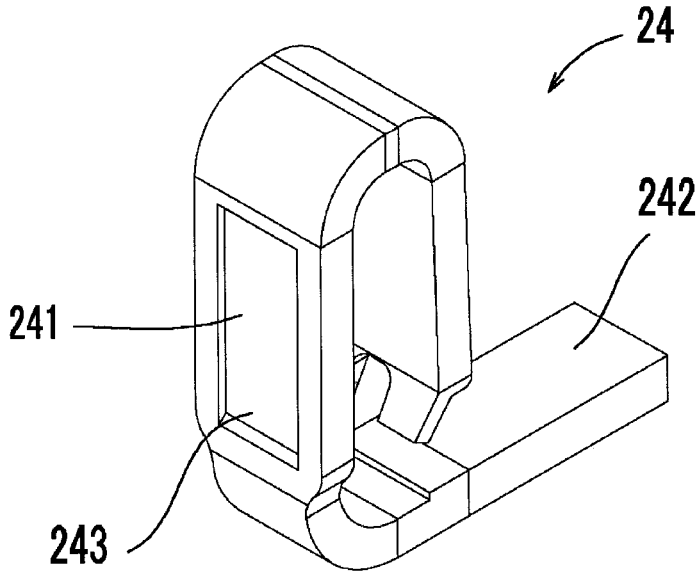
FIG. 4A is a perspective view of the plug contact of the plug connector viewed from the side of its contact portion.

The plug contact 24 is of a substantially L-shape in the illustrated embodiment as shown in FIG. 4A. The plug contact 24 comprises at least a contact portion 241 adapted to contact a receptacle contact 44 as a mating contact, and a connection portion 242 to be connected to the substrate. In the illustrated embodiment, the plug contacts 24 are held in a block 22 by integrally forming the plug contacts 24 and the block 22. The words "integrally forming" used herein are understood as signifying steps of arranging previously press-formed metal contacts in predetermined positions in molds for the block, and then injecting a plastic material into the molds to form the block (it may be called "insert method").

The contact portion 241 of said plug contact 24 is formed with a recess 243 for receiving the receptacle contact 44. The receptacle contact 44 is inserted with its first chamfered portions 446 into the recess 243 of the plug contact 24 so that any positional shifting between the contacts can be prevented, and an audible click or tactile click is generated upon contact of two mating contacts, thereby obtaining a stable connection. The shape and size of said recess 243 may be any ones so long as the recess can receive therein the receptacle contact 44 and may be suitably designed taking into account the shape and size of the receptacle contact 44 so as to obtain a stable connection between the plug and receptacle contacts.

Said connection portions 242 of the plug contacts 24 are mounted on the substrate and are of a surface mounting type (SMT) in the illustrated embodiment. However, they may be of a dip type insofar as they are able to be mounted on the substrate.

Figure 4B:
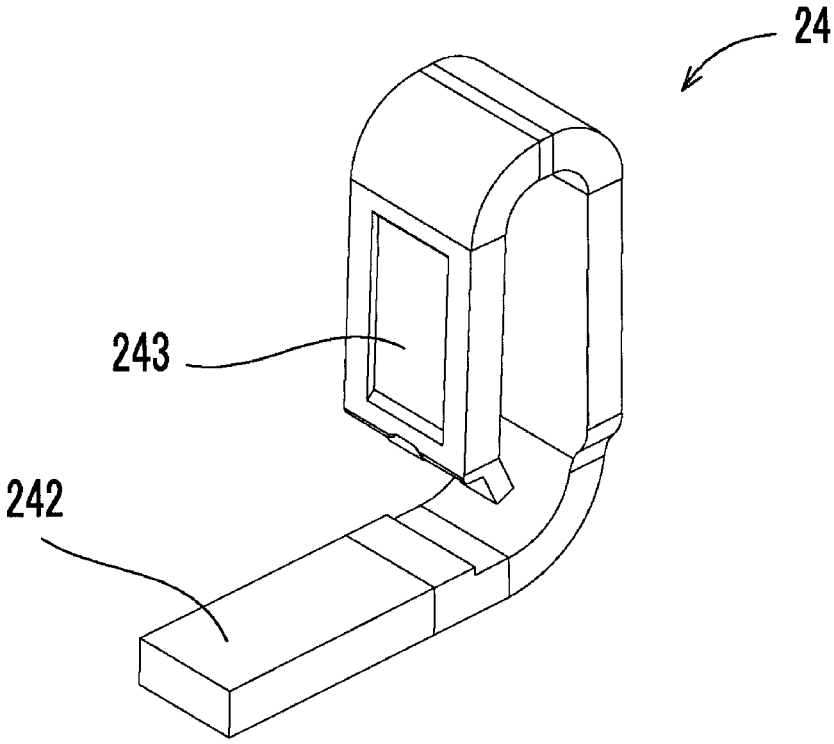
FIG. 4B is a perspective view of the plug contact viewed from the side opposite from the contact portion.

It is desirable to provide a further recess 243 on the side of the plug contact 24 opposite from the initially provided recess 243 as shown in FIG. 4B. The receptacle contact 44 is inserted with its second chamfered portions 447 into the further recess 243 so that the plug contact 24 is embraced between the first and second chamfered portions 446 and 447 of the receptacle contact 44, with the result that positional shifting between the contacts can be more effectively prevented and a more stable connection can be assured and ascertained with the aid of the audible click or tactile click. The shape and size of said further recess 243 may be any ones insofar as the further recess 243 can receive therein the receptacle contacts 44 and may be suitably designed in consideration of the shape and size of the receptacle contacts 44 so as to obtain a stable connection between the plug and receptacle contacts.

Figure 5A:
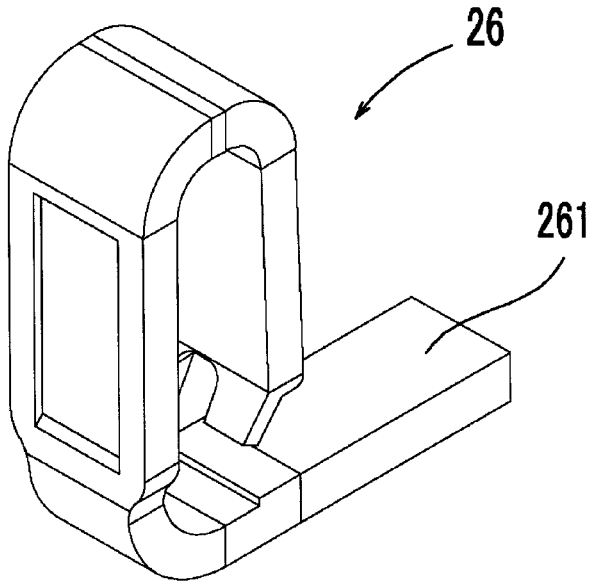
FIG. 5A is a perspective view of the plug contact shape fixture to be used in the plug connector shown in FIG. 1A.

The plug contact shape fixtures 26 and the flat shape fixtures 27 will then be explained with reference to FIGS. 5A and 5B. These fixtures 26 and 27 are made of a metal and formed by means of the press-working of the known technique. Preferred metals from which to form these fixtures include beryllium copper, phosphor bronze and the like which comply with the requirements as to springiness, formability and the like. There are two kinds of the fixtures, that is, the plug contact shape fixtures 26 whose shape is substantially the same as that of the plug contact 24 and the flat shape fixtures 27 substantially in the form of a plate as shown in FIG. 5B.

A further configuration of the plug contact shape fixtures 26 will not be described because these fixtures 26 are substantially the same as the plug contacts 24 shown in FIGS. 4A and 4B.

Figure 5B:
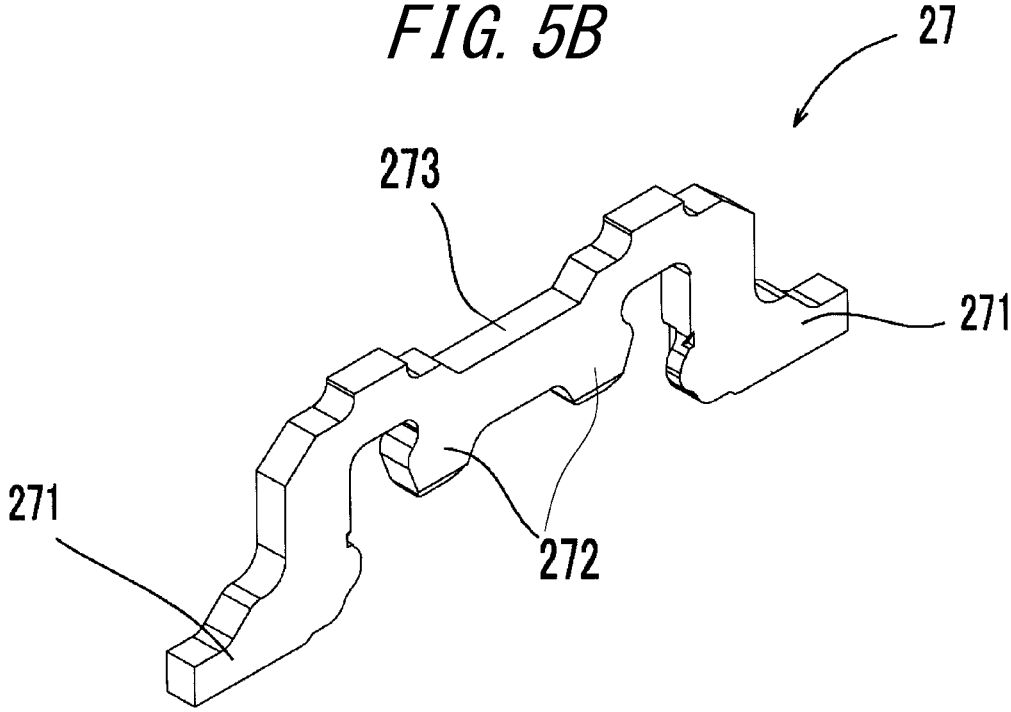
FIG. 5B is a perspective view of a flat shape first fixture to be used in a plug connector of which more details are shown in FIG. 9A.

The flat shape fixtures 27 shown in FIG. 5B will then be explained. Said flat shape fixture 27 comprises at least connection portions 271 to be connected to the substrate and a positioning depression 273 adapted to engage a positioning protrusion 423 of a housing 42 of the receptacle connector. Said flat shape fixture 27 is further provided with fixed portions 272 for fixing the flat shape fixture 27 to a block 22. In the illustrated embodiment, the connection portions 271 are of a surface mounting type (SMT) in consideration of a mounted density. However, it may be of a dip type.

Said fixed portions 272 of the flat shape fixture 27 need only be able to be fixed to the block 22, and the shape and size of the fixed portion 272 may be suitably designed in consideration of a force for holding the flat shape fixture 27 into the block 22, and further a miniaturization of the electrical connector, strength, workability, and the like. In the illustrated embodiment, the fixed portions 272 of the flat shape fixture 27 are fixed to the block 22 by press-fitting. As shown in FIG. 5B, the fixed portions 272 are located substantially at the intermediate positions between the two connection portions 271 and protrude on the side of the connection portions 271 or in the directions of the depth of said positioning depression 273 of the flat shape fixture 27 or in downward directions viewed in FIG. 5B.

When the plug connector 20 is fitted with the receptacle connector 40 as a mating connector, the positioning depression 273 of the flat shape fixture 27 engages the positioning protrusion 423 of the housing 42, thereby achieving the positioning of the plug and receptacle connectors 20 and 40 in their lateral or width directions, as is also the case with positioning recesses 221 of the block 22 shown in FIG. 1A, for which details be described. The shape and size of said positioning depression 273 may be suitably designed taking into account such functions, miniaturization of the electrical connector, strength, workability, and the like. In the illustrated embodiment, the positioning depression 273 is caved in the same direction as the protruding direction of the fixed portions 272 in consideration of the strength of the flat shape fixture 27.

Figure 3A:
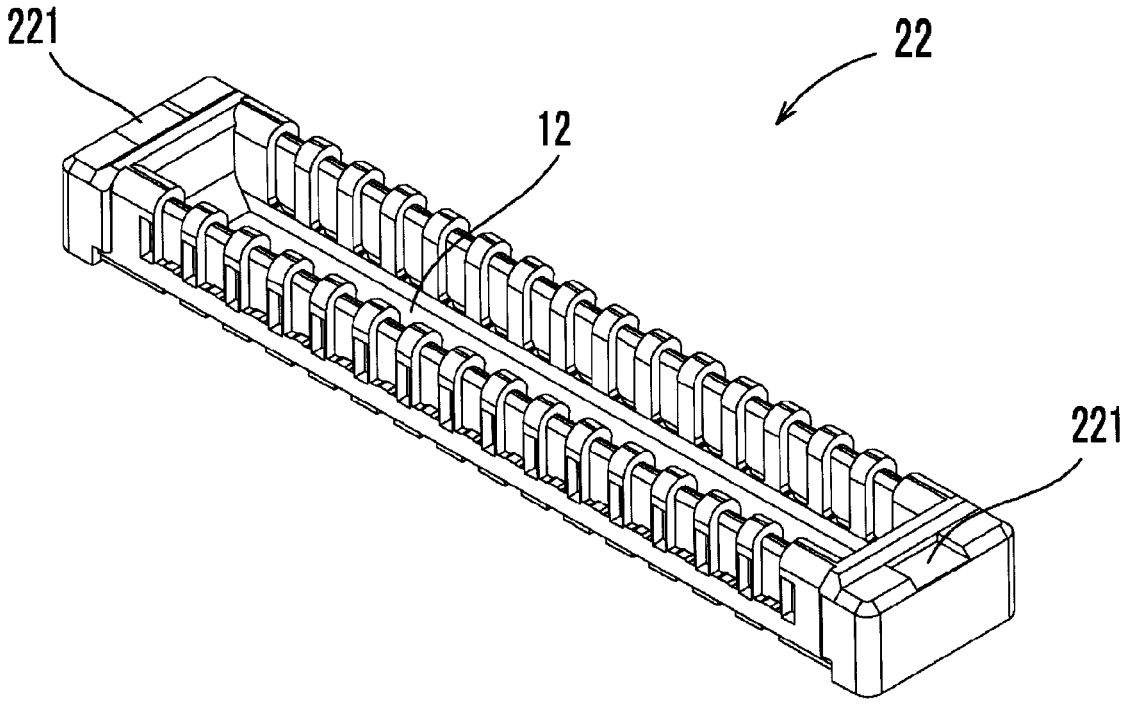
FIG. 3A is a perspective view of a block which is one component of the plug connector of the electrical connector according to the invention viewed from the fitting side.
Figure 3B:
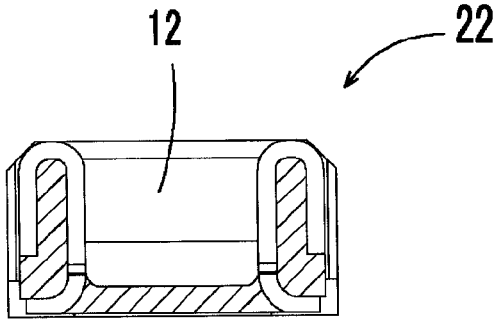
FIG. 3B is a cross-sectional view of the block taken along a portion receiving plug contacts.

The block 22 will then be explained with reference to FIGS. 3A and 3B. The block 22 is formed from an electrically insulating plastic material by means of the injection molding of the known technique. The materials for the block 22 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like, and synthetics thereof. Mounted on the block 22 are the plug contacts 24 and the plug contact shape fixtures 26 and the flat shape fixture 27.

Said block 22 is formed with a first fitting opening 12 into which a fitting portion 14 of the receptacle connector 40 is fitted. Said first fitting opening 12 need only be able to receive the fitting portion 14 of the receptacle connector 40. The shape and size of said first fitting opening 12 may be suitably designed so as to adapt said fitting portion 14 taking into account the strength, workability, connection stability, and the like.

In the case that said plug contact shape fixture 26 has the same configuration as that of said plug contacts 24, said plug contacts 24 and said plug contact shape fixtures 26 are integrally formed with said block 22 so that said plug contacts 24 and said plug contact shape fixtures 26 are securely fixed to said block 22. The words "integrally formed" are as described above. Accordingly, apertures or slots of the block 22, into which said plug contacts 24 and said plug contact shape fixtures 26 are inserted, are no longer required.

Figure 9A:
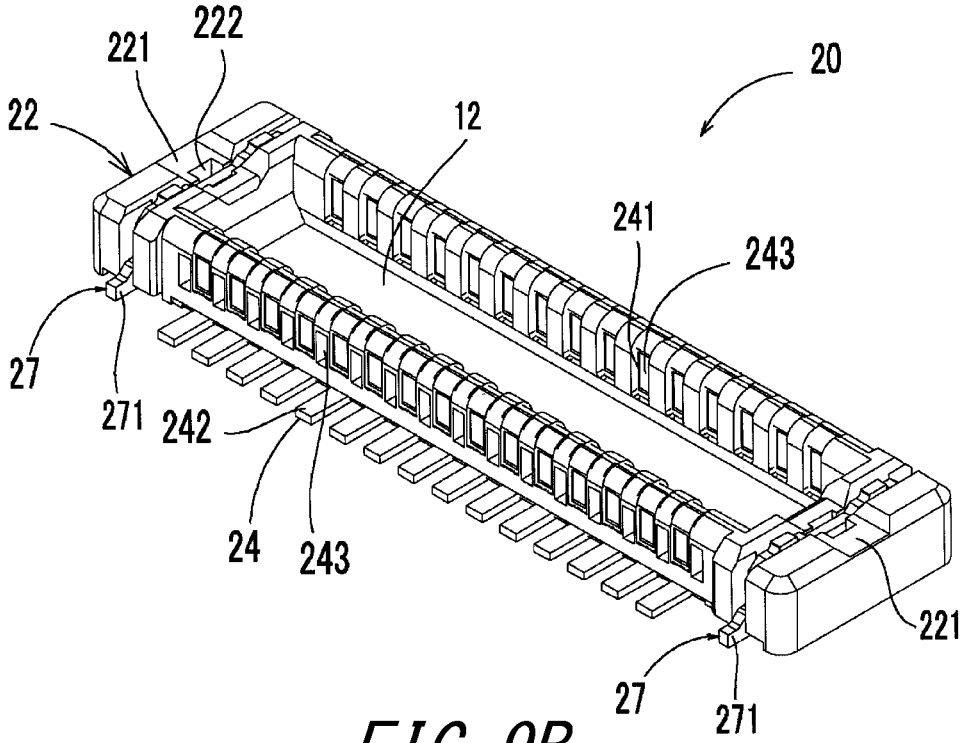
FIG. 9A is a perspective view of the plug connector using the first fixtures shown in FIG. 5B viewed from the fitting side.
Figure 9B:
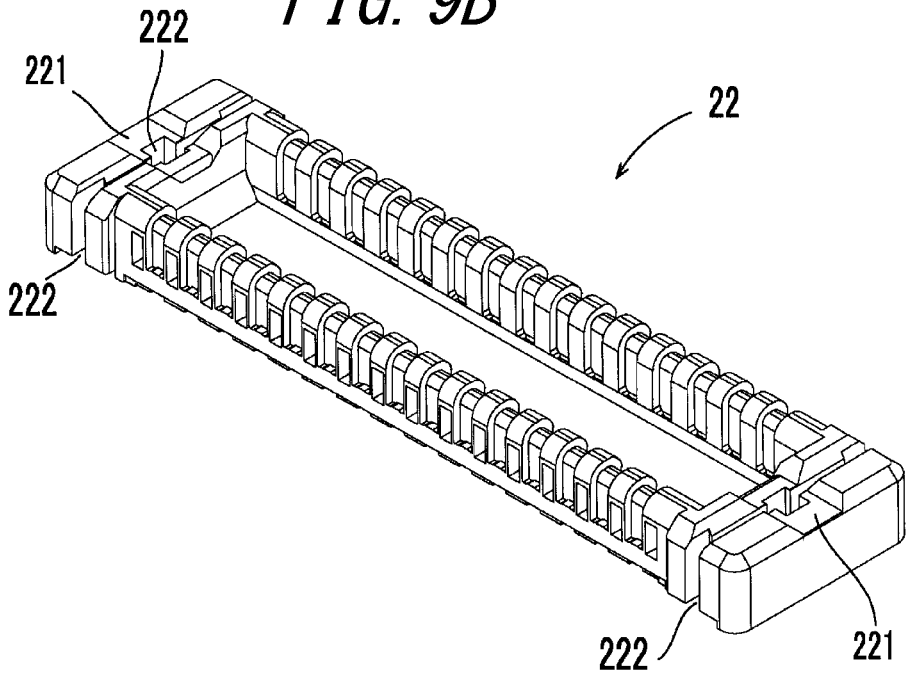
FIG. 9B is a perspective view of the block using the first fixtures shown in FIG. 5B viewed from the fitting side.

In the case that said flat shape fixtures 27 has substantially the same configuration as that shown in FIG. 5B, said block 22 is provided at both the longitudinal ends with inserting grooves 222 for receiving said flat shape fixtures 27, respectively, as shown in FIGS. 9A and 9B. The flat shape fixtures 27 are fixed in the inserting grooves 222, respectively, by means of press-fitting, hooking (lancing), welding, or the like. In the illustrated embodiment, the flat shape fixtures 27 are fixed thereto by the press-fitting. The shape and size of said inserting grooves 222 may be any ones insofar as the flat shape fixtures 27 are inserted thereinto and fixed thereto and may be suitably designed in consideration of the holding force, strength, workability, and the like.

Figure 7A:
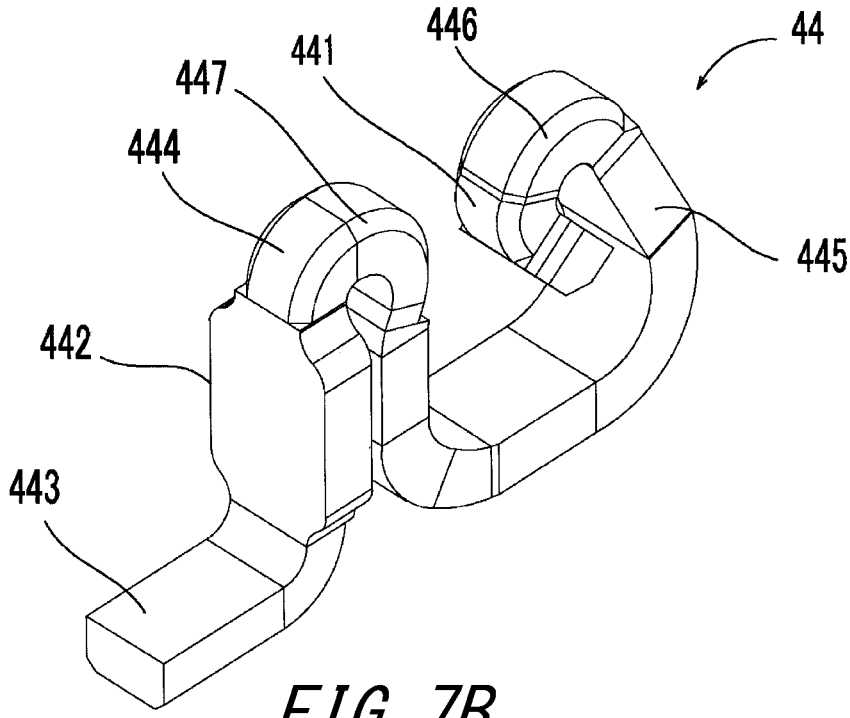
FIG. 7A is a perspective view of a receptacle contact to be used in the receptacle connector viewed from the side of its contact portion.
Figure 7B:
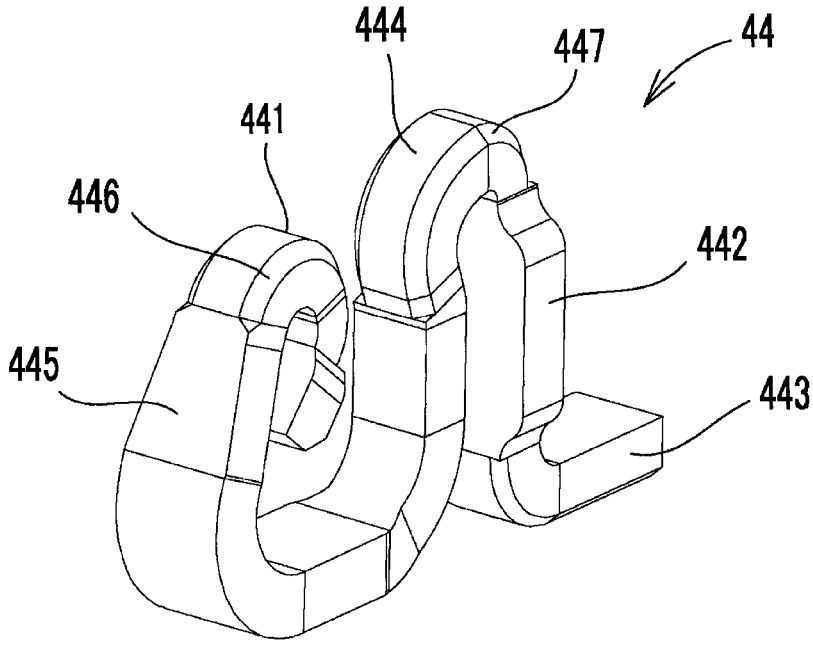
FIG. 7B is a perspective view of the receptacle contact viewed from the side opposite from the contact portion.

The receptacle connector 40 will then be explained. First, receptacle contacts 44 will be described with reference to FIGS. 7A and 7B. The receptacle contacts 44 are made of a metal and formed by means of the press-working of the known technique. Preferred metals from which to form the receptacle contacts 44 include beryllium copper, phosphor bronze and the like which comply with the requirements as to springiness, electric conductivity, and the like. Said receptacle contact 44 comprises a contact portion 441 adapted to contact said plug contact 24 as a mating contact, a connection portion 443 to be connected to the substrate, an elastic portion 444 located between said contact portion 441 and said connection portion 443 and having at least one curved portion, and a fixed portion 442 to be held in a housing 42. These portions are arranged in the order of said contact portion 441, said elastic portion 444, said fixed portion 442, and said connection portion 443. Moreover, said contact portion 441 has first chamfered portions 446 and said elastic portion 444 has second chamfered portions 447, while there is provided an inclined portion 445, which is tilted, between said elastic portion 444 and said contact portion 441.

Said contact portion 441 is adapted to contact said plug contact 24 and configured so as to be into a surface contact with the plug contact 24, thereby achieving a stable connection to the plug contact 24. As described above, said contact portion 441 is formed with the first chamfered portions 446 which make the contact portion 441 easy to fit into the recess 243 of the plug contact 24. Shapes and sizes of said contact portions 441 and said first chamfered portions 446 may be suitably designed in consideration of such a function, connection stability, workability, and the like.

Said connection portion 443 is to be mounted on the substrate and is of a surface mounting type in the illustrated embodiment. However, it may be a dip type or press-in type insofar as the connection portion can be mounted on the substrate. Such types may be selected taking into account a mounted area on the substrate, mounted density, and the like.

Said elastic portion 444 provides an elasticity and a required length of an elastic portion to obtain a stable connection to said plug contact 24. Moreover, the elastic portion 444 is formed with the second chamfered portions 447 to make the elastic portion 444 easy to fit into the recess 243 of said plug contact 24. The shapes and sizes of said elastic portion 444 and said second chamfered portions 447 may be suitably designed in consideration of such functions, connection stability, workability, and the like. In other words, said elastic portion 444 is also used as a second contact portion, and said plug contact 24 is embraced between said contact portion 441 and said elastic portion 444 to obtain a stable connection between the plug and receptacle contacts.

The inclined portion 445 provided between said contact portion 441 and said elastic portion 444 of the receptacle contacts 44 is of substantially the same configuration or substantially the same shape as that of an inclined portion 422 of an inserting hole 421 of the housing 42 later described, thereby enabling the adjustment of backup function of the housing for the receptacle contact 44 to obtain the stable connection to the plug contact 24. The shape and size of said inclined portion 445 of the receptacle contact 44 may be suitably designed so as to be commensurate with the inclined portion 422 of the housing 42 taking into account such a function, connection stability, workability, and the like.

Said fixed portion 442 of the receptacle contact 44 is to be fixed to the housing 42 by means of press-fitting, hooking (lancing), welding, or the like. In the illustrated embodiment, the fixed portion 442 of the receptacle contact 44 is fixed thereto by the press-fitting. The shape and size of said fixed portion 442 may be suitably designed taking into account the holding force, strength, workability, and the like.

Figure 6A:
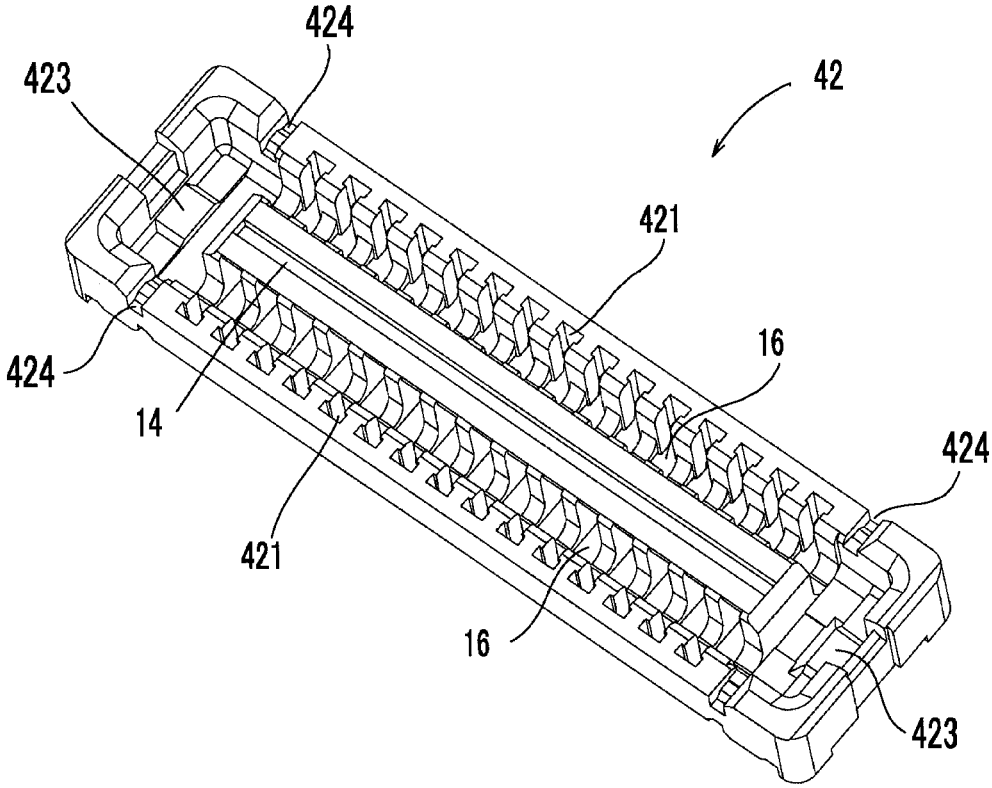
FIG. 6A is a perspective view of a housing to be used in the receptacle connector of the electrical connector according to the invention viewed from the fitting side.
Figure 6B:
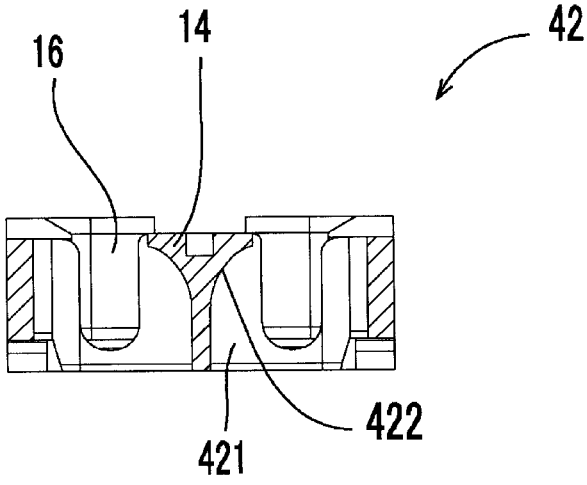
FIG. 6B is a cross-sectional view of the housing shown in FIG. 6A taken along a portion receiving receptacle contacts.

The housing 42 will then be explained with reference to FIGS. 6A and 6B. The housing 42 is formed from an electrically insulating plastic material by means of the injection molding of the known technique. The materials for the housing 42 may be suitably selected in consideration of dimensional stability, workability, manufacturing cost, and the like, and generally include polybutylene terephthalate (PBT), polyamide (66PA or 46PA), liquid crystal polymer (LCP), polycarbonate (PC), and the like, and synthetics thereof.

Said housing 42 is provided with a fitting portion 14 adapted to be fitted in the first fitting opening 12 of said plug connector 20 and second fitting openings 16 into which said plug connector 20 is fitted. The shapes and sizes of said fitting portion 14 and said second fitting openings 16 need only be able to fit into said first fitting opening 12 and to receive the plug connector 20, and may be suitably designed so as to be commensurate with shapes and sizes of mating parts in consideration of miniaturization of the electrical connector, connection stability, strength, workability, and the like.

Figure 2A:
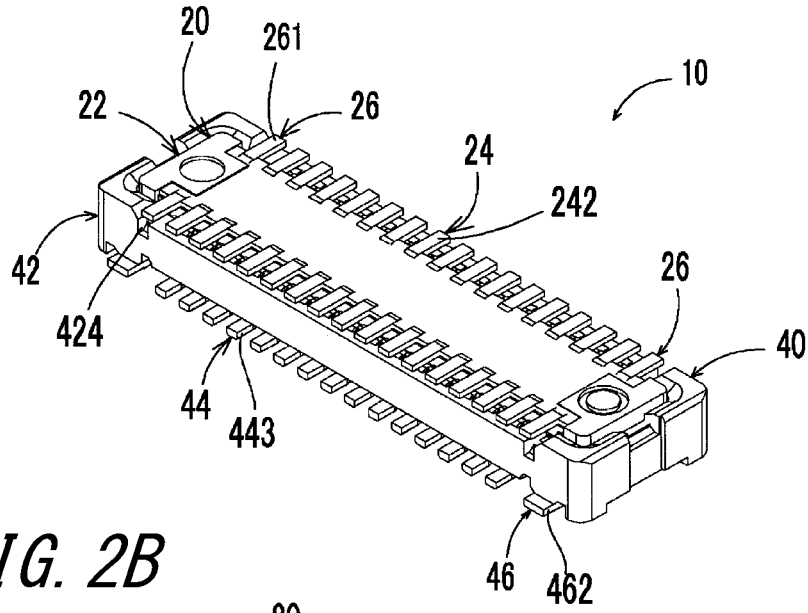
FIG. 2A is a perspective view of the plug and receptacle connectors shown in FIGS. 1A and 1B fitted with each other.
Figure 2B:
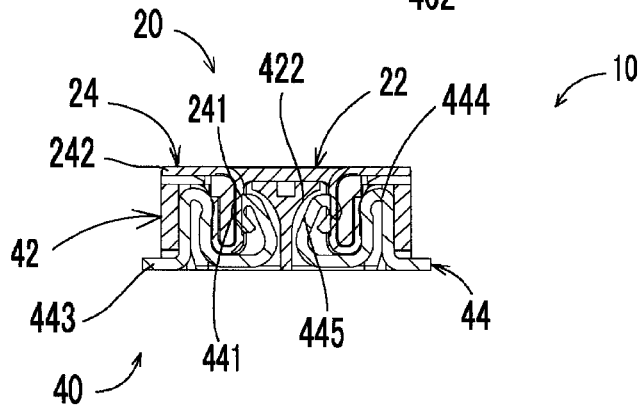
FIG. 2B is a cross-sectional view of the plug and receptacle connectors fitted with each other taken along certain contacts.
Figure 2C:
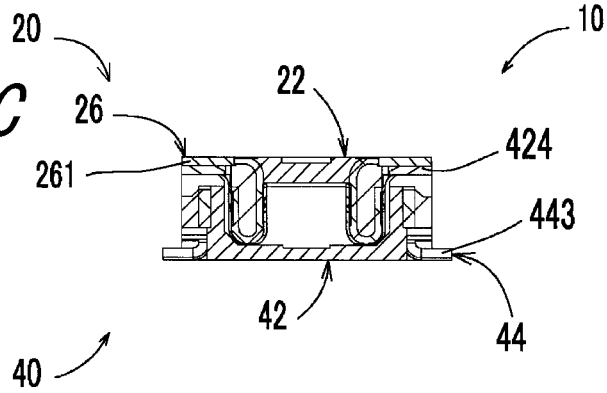
FIG. 2C is a cross-sectional view of the plug and receptacle connectors fitted with each other taken along first fixtures.

A required number of said receptacle contacts 44 and second fixtures 46 are arranged in the housing 42, for which purpose the housing 42 is formed with inserting holes 421 into which a required number of said receptacle contacts 44. Said second fixtures 46 are held in the housing 42 by means of an integral molding with the housing 42 as shown in FIG. 2A, and therefore apertures or slots for inserting said second fixtures 46 are no longer required. The inserting holes 421 shown in FIG. 6B for the receptacle contacts 44 need only be able to receive therein said receptacle contacts 44, and the shape and size of the inserting holes 421 are suitably designed in consideration of the connection stability, holding forces, strength, workability, and the like.

Said inserting hole 421 is formed with the curved inclined portion 422. The curved inclined portion 422 is commensurate with the inclined portion 445 of said receptacle contact 44 to adjust the backup function for preventing the inclined portion 445 of the receptacle contact 44 from moving away from the insertion hole 421, thereby achieving the stable connection. The shape and size of said curved inclined portion 422 may be suitably designed to be commensurate with the inclined portion 445 of said receptacle contact 44 in consideration of such a function, connection stability, workability, and the like.

Said housing 42 is provided at both the longitudinal ends with positioning protrusions 423 adapted to be fitted in positioning recesses 221 of said block 22, respectively. When the plug connector 20 and the receptacle connector 40 are engaged with each other, the positioning recesses 221 of said block 22 and said positioning protrusions 423 of said housing 42 are engaged with each other, thereby achieving the positioning of the two connectors 20 and 40 in their lateral or width directions. The shape and size of said positioning protrusions 423 may be suitably designed taking into account such a function, miniaturization of the electrical connector, strength, workability, and the like.

Said housing 42 is further provided with recesses 424 on both lateral sides of both the longitudinal ends. Such recesses 424 not only constrain said second fixtures 46 when the second fixtures 46 are integrally formed with the housing 42, but also serve as relief clearances for providing spaces for the connection portions 271 and 261 of said plug contact shape fixtures 26 and flat shape fixtures 27. The shape and size of said recesses 424 may be suitably designed in consideration of such functions, reduced overall height of the electrical connector, strength, workability, and the like.

Finally, said second fixtures 46 will be described referring to FIG. 8. The second fixtures 46 are made of a metal and formed by means of the press-working of the known technique. Preferred metals from which to form said second fixtures 46 include beryllium copper, phosphor bronze and the like which comply with the requirements as to springiness, formability, and the like.

Figure 8:
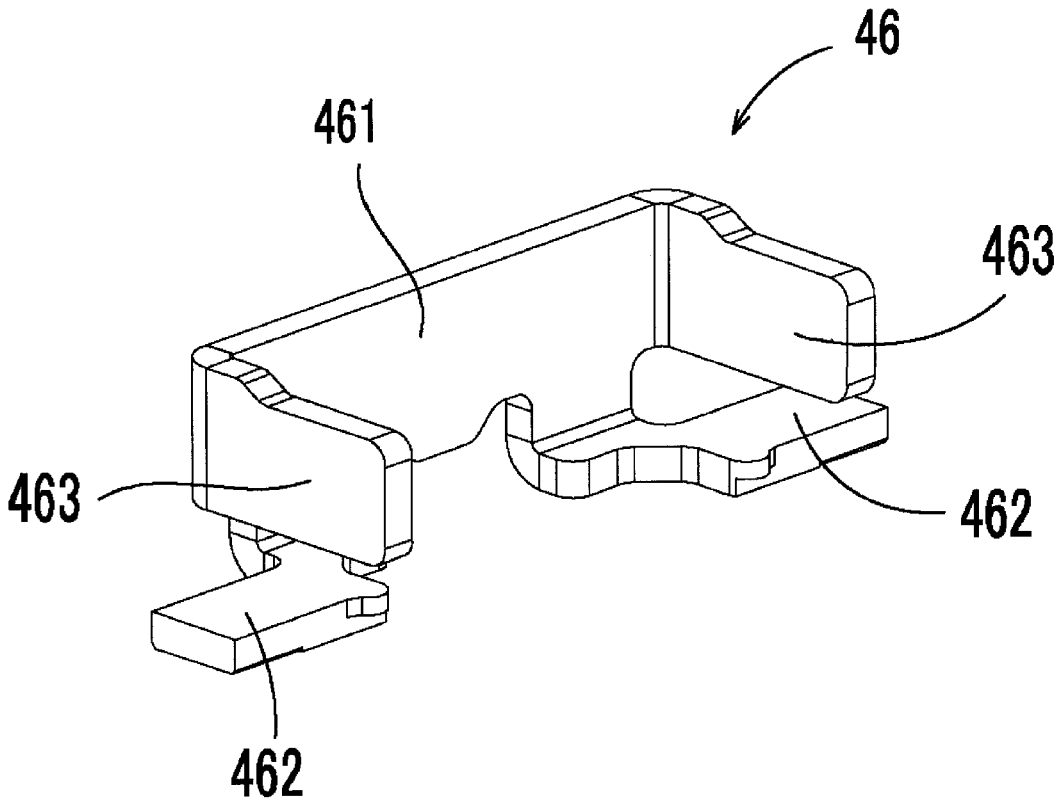
FIG. 8 is a perspective view of a second fixture to be used in the receptacle connector of the electrical connector according to the invention.

As shown in FIG. 8, said second fixture 46 comprises at least connection portions 462 to be connected to the substrate. In the illustrated embodiment, the second fixture 46 is further provided with a body section 461 and extensions 463 extending perpendicularly to said body section 463. Said connection portions 462 are of a surface mounting type (SMT) taking into account a mounted density on the substrate in the illustrated embodiment. However, it may be a dip type.

Said second fixtures 46 are held in said housing 42 by integrally forming with the housing 42. The words "integrally forming" are as described above. Said body section 461 and said extensions 463 serve to reinforce the strength of the housing 42. The shapes and sizes of said body section 461 and said extensions 463 need only enable the strength of the housing 42 to be reinforced, and suitably designed in consideration of the strength, workability, and the like.

Examples of applications of the present invention are electrical connectors for use in electric and electronic appliances and more particularly communication systems, such as mobile phone terminals, audio units, and the like. In particular, the electrical connector according to the invention has a construction maintaining a required strength and a stable fitting of plug and receptacle connectors to achieve a connection stability, and at the same time accomplishing a reduced overall height and a miniaturization (mounted space-saving construction on the substrates) of the electrical connector.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. An electrical connector including a plug connector and a receptacle connector detachably fitted with each other, said plug connector including plug contacts each having a contact portion adapted to contact a receptacle contact and a connection portion to be mounted on a substrate, a block for arranging and holding therein said plug contacts, said block having a first fitting opening for fitting therein a fitting portion of said receptacle connector, plug contact shape fixtures and flat shape fixtures each having a connection portion to be mounted on the substrate, and said receptacle connector including the receptacle contacts each having a contact portion adapted to contact said plug contact and a connection portion to be mounted on a substrate, a housing for arranging and holding therein said receptacle contacts, said housing having the fitting portion adapted to be fitted in said first fitting opening of said plug connector and second fitting openings for receiving therein said plug connector, and second fixtures each having connection portions to be mounted on the substrate, wherein said plug contacts are held in said block by integrally forming with said block, and said plug contacts are each provided with a recess into which said receptacle contact is fitted, wherein said plug contact shape fixtures and flat shape fixtures are held in both the longitudinal ends of said block, respectively, and said block is provided with positioning recesses for positioning the plug connector relative to the receptacle connector in their width directions when these connectors are fitted with each other, wherein said plug shape fixtures and said flat shape fixtures are each provided with at least one connection portion to be mounted on the substrate, wherein said receptacle contacts are each further provided between said contact portion and said connection portion with an elastic portion having at least one curved portion and with a fixed portion for holding the receptacle contact in said housing, these portions being arranged in the order of said contact portion, said elastic portion, said fixed portion and said connection portion, and further said receptacle contacts are each provided at said contact portion with first chamfered portions, at said elastic portion with second chamfered portions, and between said elastic portion and said contact portion with an inclined portion, which is tilted, wherein said housing is formed with inserting holes into which said receptacle contacts are inserted, said inserting holes each formed to have a curved inclined portion, and said housing is provided at both the longitudinal ends with positioning protrusions adapted to be fitted in said positioning recesses of said block, respectively, and said housing is further provided on both lateral sides of both the longitudinal ends with recesses for not only constraining said second fixtures when the second fixtures are integrally formed with said housing, but also serving as relief clearances for providing spaces for said connection portions of said plug contact shape fixtures and flat shape fixtures, wherein said second fixtures are held in said housing by integrally forming with the housing, and wherein when said plug and receptacle connecters are fitted with each other, said positioning recesses of said block and said positioning protrusions of said housing are engaged with each other, thereby achieving the positioning of the two connectors in their width directions, and said inclined portions of said receptacle contacts and said inclined portions of said inserting holes of the housing are of substantially the same shape so that a backup function of the housing for the receptacle contacts is adjusted, thereby achieving a stable connection between two connectors, while said first chamfered portions of said receptacle contacts are caused to engage said recesses of said plug contacts to generate tactile clicks and at the same time to achieve the positioning and contacting between said plug and receptacle contacts, and said plug contacts are embraced between said contact portions and said elastic portions of said receptacle contacts, respectively, thereby obtaining a stable connection between the plug and receptacle contacts.

2. The electrical connector as claimed in claim 1, wherein said plug contacts are each provided with a further recess for receiving therein said elastic portion of said receptacle contact.

3. The electrical connector as claimed in claim 1, wherein said plug contact shape fixtures are of substantially the same construction as that of said plug contacts and arranged on both the lateral sides of both the longitudinal ends of said block.

4. The electrical connector as claimed in claim 1, wherein said flat shape fixtures each comprise connection portions at both the ends to be mounted on said first mentioned substrate, fixed portions located in the proximity of the center of the first fixture and protruding onto the side of said connection portions, and a positioning depression for accurately positioning the plug and receptacle connectors in their width directions when these connectors are fitted with each other.

* * * * *